United States Patent [19]

Breitkreutz et al.

[11] Patent Number: 4,771,750

[45] Date of Patent: Sep. 20, 1988

[54] METHOD AND APPARATUS FOR REGULATING THE IDLING CHARGE OF AN INTERNAL COMBUSTION ENGINE

[75] Inventors: Helmut Breitkreutz, Ingershiem; Gerhard Kistner, Möglingen, both of Fed. Rep. of Germany

[73] Assignee: Robert Bosch GmbH, Stuttgart, Fed. Rep. of Germany

[21] Appl. No.: 92,006

[22] Filed: Sep. 2, 1987

[30] Foreign Application Priority Data

Sep. 4, 1986 [DE] Fed. Rep. of Germany ..... 3630086

[51] Int. Cl.[4] ..... F02D 41/16; F02M 23/04

[52] U.S. Cl. ..... 123/339; 123/585

[58] Field of Search ..... 123/339, 308, 432, 585, 123/586, 587

[56] References Cited

U.S. PATENT DOCUMENTS

| | | | |
|---|---|---|---|
| 2,833,260 | 5/1958 | Dolza et al. | 123/585 |
| 2,939,444 | 6/1960 | Leibing | 123/361 X |
| 3,023,745 | 3/1962 | Barnes | 123/587 |
| 3,664,316 | 5/1972 | Garcea | 123/585 |
| 3,713,630 | 1/1973 | Laprade et al. | 123/442 X |
| 4,494,517 | 1/1985 | Kratt et al. | 123/585 |

FOREIGN PATENT DOCUMENTS

| | | | |
|---|---|---|---|
| 75532 | 6/1980 | Japan | 123/587 |

*Primary Examiner*—Tony M. Argenbright
*Attorney, Agent, or Firm*—Edwin E. Greigg

[57] ABSTRACT

An apparatus is proposed for regulating the idling charge of an internal combustion engine having at least two banks each including a plurality of engine cylinders. Each bank has its own air intake line with throttle valves. Bypassing each throttle valve is a bypass line, in which a throttle opening is openable, each by a respective rotating slide, in accordance with engine operating characteristics by means of a common control motor via a common pivot shaft.

5 Claims, 2 Drawing Sheets

METHOD AND APPARATUS FOR REGULATING THE IDLING CHARGE OF AN INTERNAL COMBUSTION ENGINE

BACKGROUND OF THE INVENTION

The invention is based on a method and on an apparatus for regulating the idling charge of an internal combustion engine as defined hereinafter. An apparatus for regulating the idling charge in V engines having separate air intake lines has already been proposed, in which an idling charge regulator that is driven by its own control motor is disposed in a bypass line around a throttle valve disposed in each air intake line. Besides requiring two control motors, this arrangement presents difficulties in regulating the idling charge because of the different characteristic curves of these two idling charge regulators.

OBJECT AND SUMMARY OF THE INVENTION

The method according to the invention and the apparatus have the advantage over the prior art that only one control motor, which can be regulated in a simple manner, is required for regulating the idling charge of an internal combustion engine having at least two banks of cylinders and separate air intake lines.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
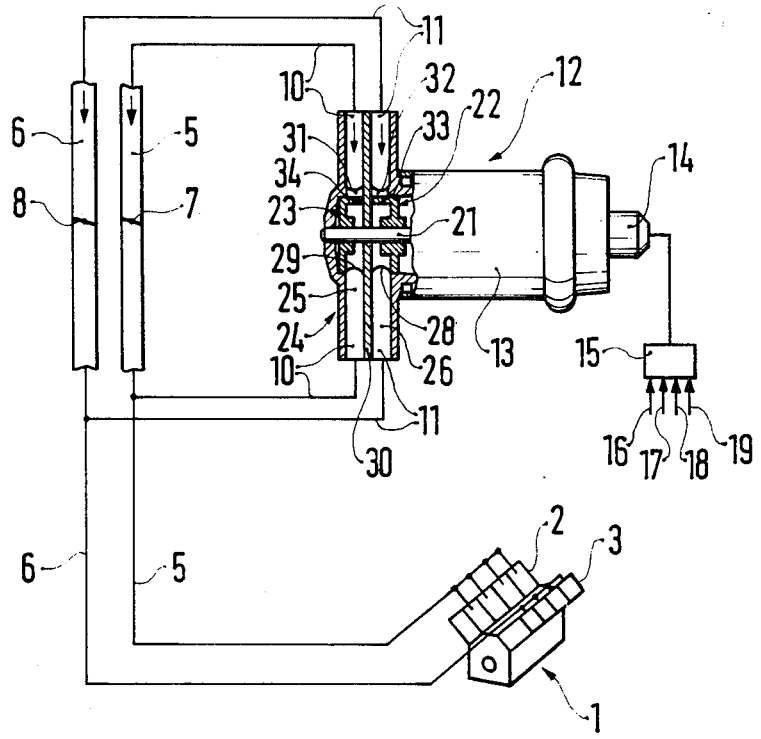
FIG. 1 shows an exemplary embodiment of the invention in simplified form.

In the exemplary embodiment of the invention shown in the drawing, 1 is a mixture-compressing internal combustion engine having externally supplied ignition, in the form of a V engine that has a first bank 2 of cylinders and a second bank 3 of cylinders. The first bank 2 and the second bank 3 each have four cylinders, for example. In other words, the exemplary embodiment relates to an eight-cylinder V-type engine. The invention is not restricted to this exemplary embodiment, however; it is fundamentally applicable to any internal combustion engine having at least two banks of cylinders. An air intake line 5 is associated with the first bank 2 and an air intake line 6 is associated with the second bank 3. The air intake lines 5, 6 do not communicate with one another. In a known manner, a throttle valve 7 and a throttle valve 8 are disposed in the air intake lines 5 and 6, respectively. Combustion air flows via the air intake lines 5, 6, past the throttle valves 7, 8, to the engine cylinders of the banks 2, 3. From upstream of the throttle valve 7 to downstream of the throttle valve 7, a bypass line 10 leads from and to the air intake line 5, and a bypass line 11 leads from upstream of the throttle valve 8 to downstream of the throttle valve 8 from and to the air intake line 6. The cross section of the bypass lines 10, 11 is controllable by means of an idling charge regulator 12. An electric motor 13 serves as the control motor of the idling charge regulator in the present exemplary embodiment, not shown in further detail, which is triggerable via a plug 14 by an electronic control unit 15 in accordance with operating characteristics of the engine 1 such as the supply voltage 15, the rpm 17 of the engine 1 picked up by the ignition distributor, the engine temperature 18, the position 19 of the throttle valves 7, 8, and others. The electric motor 13 is adapted to turn a pivot shaft 21, which serves as a control element and with which two rotating slides 22, 23 are arranged to serve as control devices and these slides are connected in such a way that they are fixed against relative rotation and thus are simultaneously rotatable. Remote from the electric motor 13, the pivot shaft 21 passes through a bypass body 24 of the idling charge regulator 12, which body surrounds a portion 25 of the bypass line 10 and a portion 26 of the bypass line 11, such that the lines 10 and 11 are separated from one another by a partition 30. The slide 22 is rotatably supported in a control opening 28, which intersects the portion 26 in the bypass body 24, and the rotating slide 23 is rotatably supported in a control opening 29 that is in alignment with the control opening 28 and which intersects the portion 25 of the bypass line 10 in the bypass body 24. The portions 25 and 26 of the bypass lines 10, 11 in the bypass body 24 and the control openings 28, 29 are separated from one another by the partition 30; the only element that passes through this partition is the pivot shaft 21, which does so in a well sealed manner. The bypass line 10 discharges in the flow direction via a throttle opening 31 into the control opening 29, and the bypass line 11 discharges via a throttle opening 32 into the control opening 28. With a circular-section-shaped control section 33, the rotatable slide 22 passes through the control opening 28 and opens the throttle opening 32, and hence the flow cross section of the bypass line 11, to a variable extent depending on the position of the rotatable slide 22. With a circular-section-shaped control section 34, the rotatable slide 23 passes through the control opening 29 and with the control section 34 opens the throttle opening 32, and hence the flow cross section of the bypass line 10, to a variable extent depending on the position of the rotatable slide 23. The rotation of the rotatable slides 22 and 23 is effected simultaneously by means of the common electric motor 13 via the common pivot shaft 21, as a result of which a variable amount of additional air is directed to the engine 1 via the bypass lines 10, 11, for instance for regulating a predetermined idling rpm.

Figure 2:
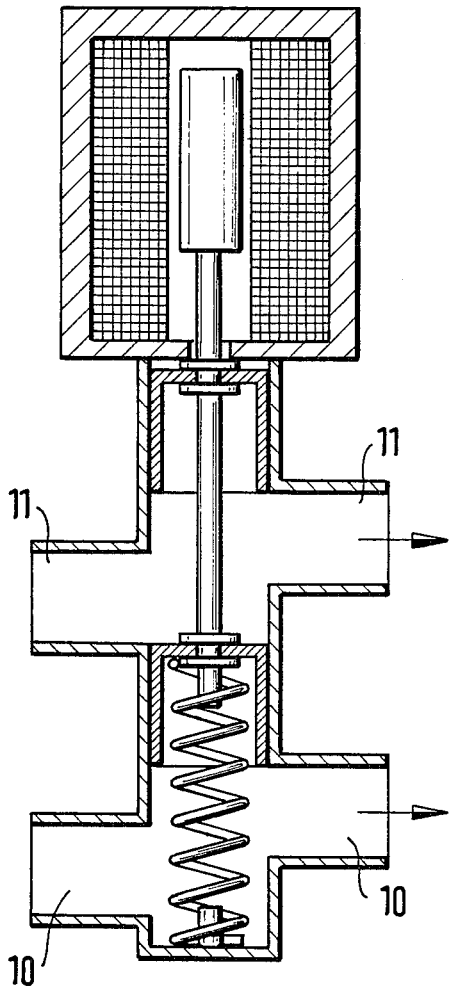
FIG. 2 is a modification of FIG. 1.

Instead of the rotatable slides 22, 23, axial slides may also be provided, as shown in FIG. 2, these slide open the flow cross sections of the bypass lines 10, 11 simultaneously to a variable extent and are displaced in the axial direction by a common axial slide shaft, which can for instance be displaced by a reciprocating magnet system as a function of the engine operating characteristics.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A method for regulating the idling charge of an internal combustion engine having at least two banks of cylinders, each of said banks of cylinders having an air intake line associated with said cylinders, the steps of providing an intake line for each of said banks of cylinders, positioning throttle valves in each of said intake lines, providing bypass lines that lead around each of said throttle valves, controlling a throttle opening in each of said bypass lines to a variable extent by a control means in accordance with operating characteristics of said engine, and actuating said control means by a common control motor.

2. An apparatus for regulating the idling charge of an internal combustion engine comprising at least two banks of cylinders, each of said banks of cylinders being provided with an own air intake line and each intake line further including a throttle valve provided with a bypass line, a throttle opening in said bypass line said throttle opening adapted to be opened to a variable extent by a respective control means in accordance with operating characteristics of said engine, said control means being secured on a common control element and said control element being actuatable by means of a control motor.

3. An apparatus as defined by claim 2, in which said control means comprise rotatable slide means and said control element further includes a pivot shaft.

4. An apparatus as defined by claim 2, in which said control means comprise axial slide means and said control element further includes an axially disposed shaft means adapted to control said axial slide means in accordance with engine operating characteristics.

5. An apparatus as defined by claim 4, in which said axial slide means is displaced by a reciprocating magnet system.

* * * * *